US006286445B1

(12) United States Patent
Rosa et al.

(10) Patent No.: US 6,286,445 B1
(45) Date of Patent: Sep. 11, 2001

(54) UNITARY DOUBLE-ACTING PISTON THREAD CUTTER ASSEMBLY

(75) Inventors: Salvatore Rosa, Elmwood Park; Louis Malchiodi, Hillsdale, both of NJ (US)

(73) Assignee: Clinton Industries, Inc., Carlstadt, NJ (US)

( * ) Notice: Subject to any disclaimer, the term of this patent is extended or adjusted under 35 U.S.C. 154(b) by 0 days.

(21) Appl. No.: 09/405,908

(22) Filed: Sep. 24, 1999

(51) Int. Cl.[7] ..... D05B 65/00
(52) U.S. Cl. ..... 112/288
(58) Field of Search ..... 112/288, 292, 112/295, 301, 287, 286; 83/905, 910, 936

(56) References Cited

U.S. PATENT DOCUMENTS

| | | | | |
|---|---|---|---|---|
| 3,242,892 | * | 3/1966 | Fowler | 112/287 |
| 3,250,237 | * | 5/1966 | Myska | 112/288 |
| 3,430,592 | * | 3/1969 | Florczak | 112/288 |
| 3,648,634 | * | 3/1972 | Van Hazendonk | 112/292 |
| 3,696,770 | * | 10/1972 | Dunne et al. | 112/288 |
| 3,815,533 | * | 6/1974 | Bray | 112/288 |
| 4,202,286 | * | 5/1980 | Freire Costas | 112/286 |
| 4,453,481 | * | 6/1984 | Garnett et al. | 112/288 |
| 5,127,350 | * | 7/1992 | Okada et al. | 112/295 X |

OTHER PUBLICATIONS

Clinton Service Guide Model 3115FCA for Flat Bed Machines (1994).

* cited by examiner

*Primary Examiner*—Ismael Izaguirre
(74) *Attorney, Agent, or Firm*—Darby & Darby

(57) ABSTRACT

A unitary double-acting piston thread cutter assembly having a housing including an integrated cutter section and drive section forming a single unitary device. The thread cutter assembly includes a universal tension mount for releasably securing the thread cutter assembly to the top plate of a variety of different types and models of sewing machine. A V-shaped moveable blade has two sides with a pivot point defined at the intersection of the sides. Along one side of the moveable blade is disposed a cutting or knife edge. A double-acting piston and drive link are disposed longitudinally in the housing and connected so that they are both displaced at the same time. The drive link is also connected to the side of the moveable blade opposite that of the cutting or knife edge, so that movement of the piston and drive link in a longitudinal direction, in turn, causes the moveable blade to be displaced, whereby the cutting or knife edge of the moveable blade engages with that of a stationary blade and severs the thread chain.

7 Claims, 3 Drawing Sheets

UNITARY DOUBLE-ACTING PISTON THREAD CUTTER ASSEMBLY

BACKGROUND OF THE INVENTION

1. Field of the Invention

The present invention is directed to a sewing machine, and in particular, to a unitary double-acting piston chain thread cutter assembly for a sewing machine.

2. Description of Related Art

Sewing machines are used to produce a multitude of garments at a high speed of production. Chain threads between garments must be cut quickly, and preferably, without stopping the production of the next garment.

Chain thread cutter assemblies are widely used for cutting the chain thread formation between garments or pieces. By way of example, Clinton Industries manufactures a cutter assembly (model 3115FCA) that is permanently mounted via screws drilled into the top plate of the sewing machine. The cutter assembly comprises two separate sections: a driver section and a body section. To install the cutter assembly holes must first be drilled in the top plate of the sewing machine. Then the body section is secured to the top plate of the sewing machine behind the presser foot via screws. The driver section is placed behind the body section and slid together so that projection members extending from the driver section are received in complementary shaped apertures defined in the body section. A guard is positioned so that it extends over the top surface of both sections and secured via a screw to the driver section. Because of the separate components, assembly of the cutter assembly is time consuming and requires proper alignment of the two sections so that the guard fits over the top. Another disadvantage of this conventional device is that it is permanently affixed to the top plate of the sewing machine and thus can not be readily removed. The driver section includes a driving piston. During installation the driver section is arranged in the lateral direction so that the driving piston is substantially perpendicular to the direction of the cutter assembly. This is disadvantageous in that it is difficult to mount the assembly on space restricted overedge machines.

It is therefore desirable to provide a unitary chain thread cutter assembly that may be readily and releasably mounted to a wide variety of sewing machines.

SUMMARY OF THE INVENTION

An object of the present invention is to develop an integrated chain thread cutter and driver as a single unitary device thereby making the device more compact and reducing the time necessary for assembly.

Another object of the present invention is to provide a universal chain thread cutter that is releasably mountable to a wide variety of sewing machines. In accordance with the present invention the unitary double-acting thread cutter includes an integrated cutter section and drive section forming a single unitary device. The thread cutter assembly also includes a universal tension mount for releasably securing the thread cutter assembly to the top plate of a variety of different types and models of sewing machine. A V-shaped moveable blade has two sides with a pivot point defined at the intersection of the sides. Along one side of the moveable blade is disposed a cutting or knife edge. A double-acting piston and drive link are disposed longitudinally in the housing and connected so that they are both displaced at the same time. The drive link is also connected to the side of the moveable blade opposite that of the cutting or knife edge, so that movement of the piston and drive link in a longitudinal direction, in turn, causes the moveable blade to be displaced, whereby the cutting or knife edge of the moveable blade engages with that of a stationary blade and severs the thread chain.

BRIEF DESCRIPTION OF THE DRAWING

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE PREFERRED EMBODIMENTS

Figure 1:
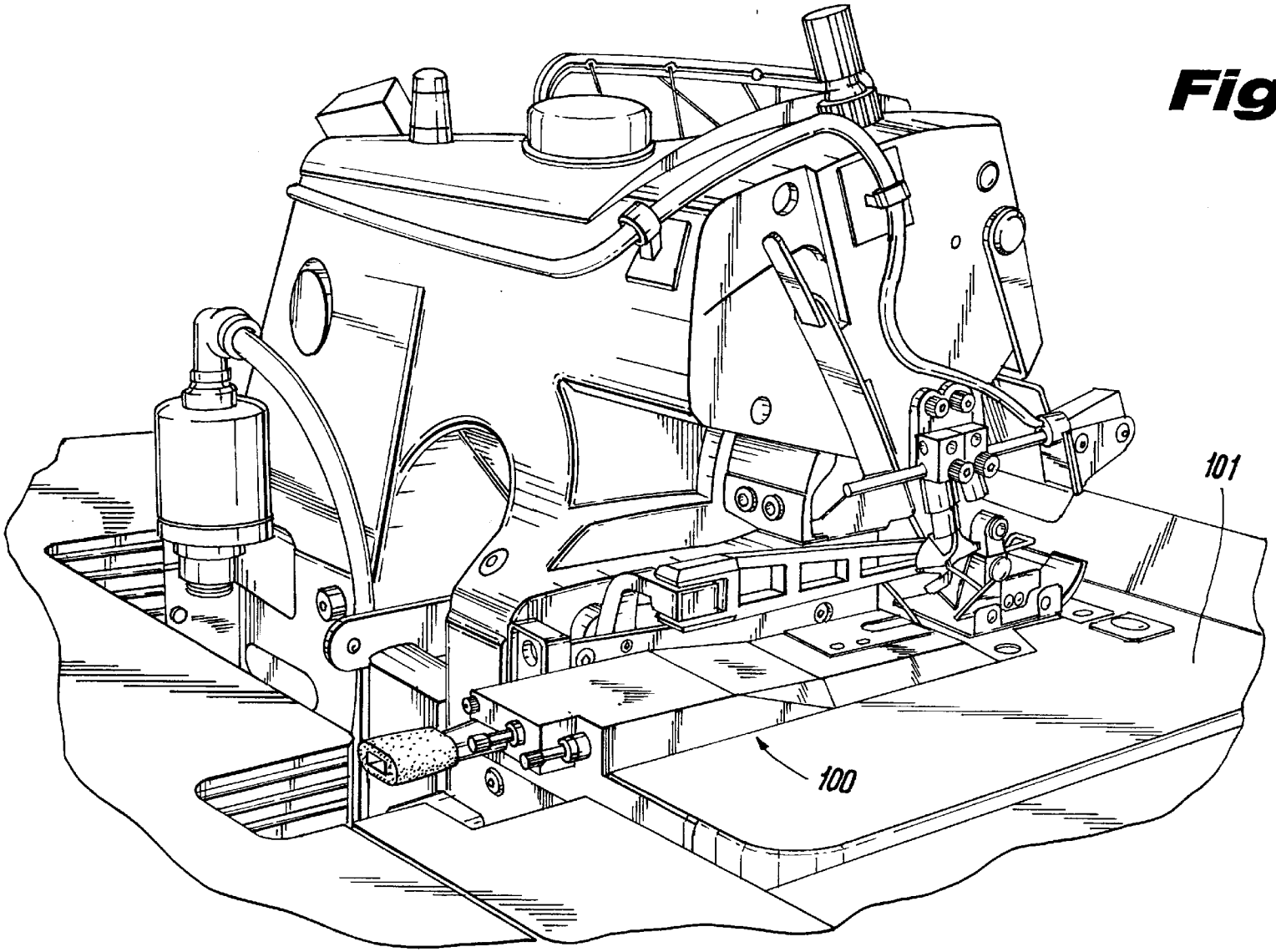
FIG. 1 is an exemplary perspective view of the unitary double-acting piston chain thread cutter assembly mounted to a sewing machine in accordance with the present invention.
Figure 4:
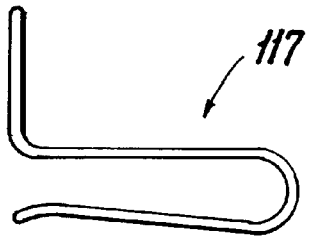
FIG. 4 is an end view of the universal tension mount in FIG. 1.
Figure 5:
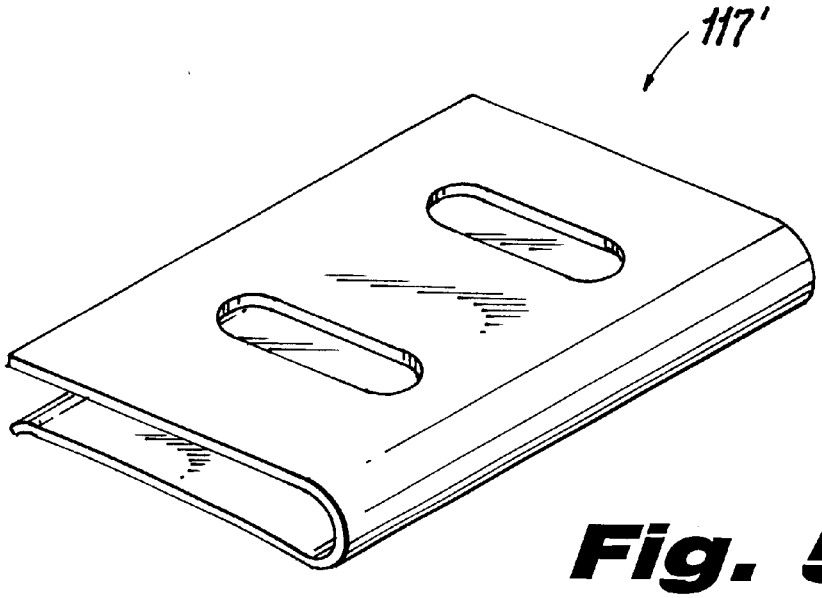
FIG. 5 is a perspective view of an alternative embodiment of the universal tension mount.

An exemplary perspective view of the unitary double-acting piston chain thread cutter assembly 100 is shown in FIG. 1 releasably mounted to a top plate 101 of a sewing machine by a universal tension mount 115. Referring to the exploded view in FIG. 2 the chain thread cutter assembly is a unitary device including two portions (a cutter portion 125 and a driving portion 130) that are enclosed by a housing 105. The proximal end of the unitary device terminates in a cutter guard 135, which is sloped or tapered towards the top plate of the sewing machine to which the assembly is releasably mounted. A U-shaped channel 120 is defined in and extends longitudinally through the housing 105. In a preferred embodiment, the distal end of the U-shaped channel 120 is arranged with its open side facing the rear surface of the housing, while towards the proximal end s open side of the channel faces the front surface of the housing. A tube assembly 140 is inserted into a portion of the U-shaped channel. Tube assembly 140 is attached to a vacuum source that imparts negative pressure to carry the cut chain thread away from the sewing machine and into a disposal container (not shown) after having been severed, as described in detail below. The shape of the channel is not critical and any desired shape is contemplated and within the intended scope of the invention so long as the shape of the channel and tube assembly are complementary to one another. A portion of the upper facing 109 of the proximate end of the housing is preferably removed or cut away to reveal an intermediate surface 107. Housing 105 has a hole 175 located in a region of the proximal end and extending laterally from the intermediate surface 107 through to the lower facing. The universal tension mount 115 has an n-shaped lateral cross-section (as shown in FIG. 4) with one side thereof mounted to a side of the housing 105, while its other side projects substantially perpendicular thereto and forms a tension sleeve 117 for receiving the side edge of the top plate 101 of the sewing machine. Alternatively, the universal tension mount may be substantially flat, as in shown in FIG. 5, to allow for lateral placement on the side edge of the top plate 101 of the sewing machine. The chain thread cutter assembly is therefore universal in that it can be releasably secured via the tension sleeve 117 to a wide variety of different types and models of sewing machines which have not been manufactured to include a chain thread cutter assembly. This is especially advantageous in that instead of having to purchase new machines equipped with a chain thread cutter assembly, existing machines may be economically converted or adapted using this universal device.

Figure 2:
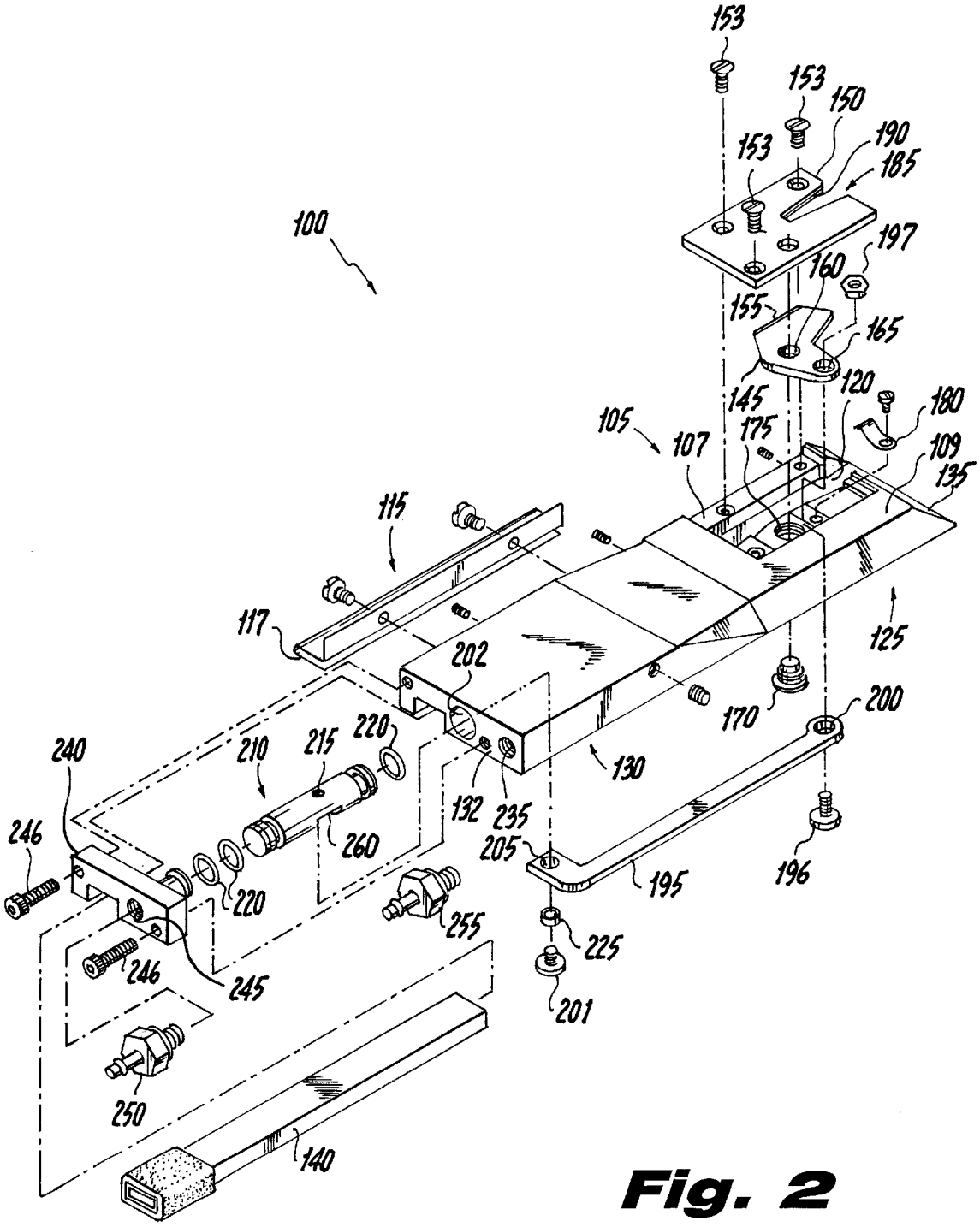
FIG. 2 is an exploded view of the unitary double-acting piston chain thread cutter assembly of FIG. 1.

Referring to FIG. 2, the chain thread is cut or severed by the cooperation of a movable blade 145 with a fixed or stationary blade 150. Movable blade 145 is substantially V-shaped with a cutting or knife edge 155 extending along one side and two apertures 160, 165 defined therein. Pivoting aperture 160 is substantially centered and receives a screw or pin pivot 170 about which the movable blade 145 may freely pivot, while displacing aperture 165 is offset from the pivoting aperture 160 along the side opposite the side of the cutting or knife edge 155. A flexible spring 180, such as a curved flexible metal tab, is secured to the intermediate surface 107, proximate the hole 175, for displacing the movable blade 145 away from the housing thereby reducing friction between the intermediate surface 107 and the lower surface of the movable blade and prolonging the life of the movable blade. The movable blade 145 is arranged on top of the intermediate surface 107, with spring 180 interposed therebetween, and pivotally mounted thereto by the screw or pin pivot 170 inserted through the hole 175 and pivoting aperture 160.

Stationary blade 150 has a V-shaped channel 185 with a cutting or knife edge 190 arranged along one side of the channel. The stationary blade is placed on top of the moveable blade 145 and secured, for example, by screws 153, to the intermediate surface 107 of the housing 105 with the opening of the V-shaped channel 185 and the U-shaped channel 120 substantially aligned so that after being severed the chain thread is propelled through the U-shaped channel 120 and the tube assembly 140, and delivered into a container for disposal. In a preferred embodiment, when the stationary blade 150 is mounted to the intermediate surface 107 its upper surface is substantially flush with the upper surface of the housing so that the garment easily glides thereover.

Figure 3:
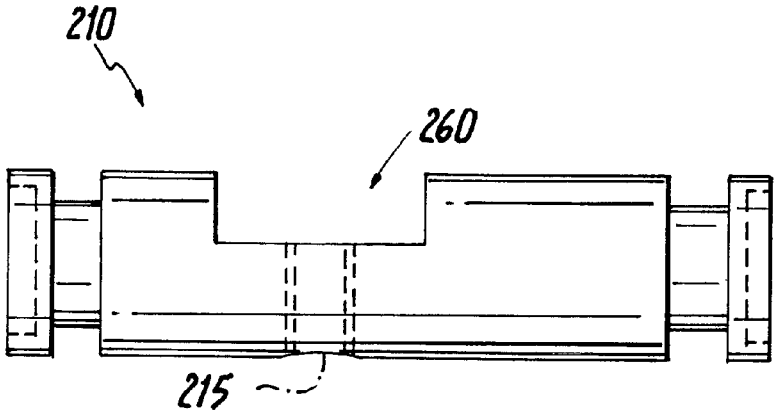
FIG. 3 is a side view of the driving piston assembly in FIG. 1.

Next, will be described the assembly for displacing the movable blade 145. An L-shaped drive link 195 is longitudinally disposed within a cylindrical bore 202 in the housing. A hole 200 is defined in one end of the drive link, while another hole 205 is defined in the opposite end. A screw 196 inserted through the hole 200 and driving aperture 165 is received in nut 197 to secure the moveable blade 145 and drive link 195 together. A driving piston assembly 210 is disposed longitudinally in the housing 105 and has a portion of its outer surface cut away to form a U-shaped groove 260 in a direction substantially perpendicular to its longitudinal axis, as shown in FIG. 3. Arrangement of the driving piston in the longitudinal direction provides greater flexibility in mounting on space restricted overedge machines. A free end of the shorter side of the drive link 195 is received in the U-shaped groove 260 and secured therein by a screw 201 passing through a bushing 225, the hole 205 and aperture 215. Driving piston assembly 210 is inserted in the cylindrical bore 202 defined and extending in a longitudinal direction through a portion of the housing 105. One or more O-rings or gaskets 220 are inserted into the cylindrical bore 202 and disposed on each end of the driving piston assembly 210. An air channel 235 is defined so as to extend from the distal end 130 of the housing 105 and connect with the cylindrical bore 202 in front of the driving piston assembly 210 when inserted therein.

An end cap 240 is secured by screws 246 to a portion of the distal end 130 of the housing 105, thereby leaving exposed the entrance to the air channel 235. The U-shaped channel 120 defined in the housing 105 also extends through the end cap 240. An opening 245 is defined in the end cap 240 and substantially aligned with the cylindrical bore 202. One hose fitting 250 is inserted into the opening 245 in the end cap, while another hose fitting 255 is inserted into the air channel 235. Hose fittings 250, 255 are connected to an air supply source (not shown) and a vacuum source (not shown) connected to tube assembly 140.

Operation of the double-acting driving piston assembly 210 will now be described in detail. Air pressure is induced in one of the two hose fittings 250, 255 while the air is exhausted through the other hose fitting, thereby causing the driving piston assembly 210 to oscillate within the cylindrical core 202. In a home position (non-cutting position), the movable blade 145 is arranged so that the blade or knife edge 155 is displaced a maximum distance relative to the blade or knife edge 190 of the stationary blade 150. When the thread chain is to be cut, air from the supply source is pumped into the hose fitting 250 and builds up at the distal end of the driving piston assembly 210. Simultaneously air is released from the proximal end of the driving piston assembly and exhausted out through hose fitting 255. As a result of this pressure differential, the driving piston assembly 210 is displaced in a longitudinal direction towards the proximal end of the housing 105. The drive link 195 mounted to the driving piston assembly 210 is also displaced by the same distance in the longitudinal direction towards the proximal end of the housing. Displacement of the drive link 195 towards the proximal end of the housing, in turn, causes the blade or knife edge 155 of the movable blade 145 to rotate in a counter-clockwise direction about the screw pivot 170 and engage the blade or knife edge 190 of the stationary blade 150, thereby cutting the chain thread disposed therebetween. Once cut, the chain thread is propelled through the U-shaped channel 120 and the tube assembly 140 into a disposal container (not shown).

A reverse operation is performed to return the movable blade back to its home position (non-cutting position). Specifically, air is induced into the proximal end of the driving piston assembly 210 via hose fitting 255, while air is exhausted out from the distal end of the driving piston assembly 210 via hose fitting 250. The pressure differential, in turn, displaces the driving piston assembly 210 in a longitudinal direction back towards the distal end of the housing 105. Simultaneously, the drive link 195 mounted to the driving piston assembly 210 is displaced by the same distance in the longitudinal direction towards the distal end of the housing. Displacement of the drive link 195 towards the distal end of the housing, in turn, causes the blade or knife edge 155 of the movable blade 145 to rotate in a clockwise direction about the screw pivot 170 away from the blade or knife edge 190 of the stationary blade 150.

The unitary construction of the thread cutter assembly in accordance with the present invention makes the device more compact and requires less time to install on a sewing machine. In addition, because of the universal tension mount the thread cutter assembly in accordance with the present invention may be installed on sewing machines that are otherwise not equipped with such device, without having to incur the cost for new machines.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims as appended hereto.

What is claimed is:

1. A unitary chain thread cutter assembly for a sewing machine having a top plate, comprising:

a single housing enclosing a cutter section and a driver section integral with said cutter section to form a unitary device, said housing being adapted to be mounted to the top plate; and a releasable universal tension mount affixed to said housing and adapted to receive the top plate of the sewing machine.

2. A unitary chain thread cutter assembly in accordance with claim 1, wherein said cutter section comprises:

a stationary blade having a cutting edge; and a V-shaped moveable blade having a first side and a second side, said moveable blade having a cutting edge disposed along the first side, and a pivoting aperture defining a pivot point proximate an intersection of the first and second sides.

3. A unitary chain thread cutter assembly in accordance with claim 2, wherein said movable blade freely rotates about the pivot point.

4. A unitary chain thread cutter assembly in accordance with claim 3, further comprising an L-shaped drive link extending in a longitudinal direction, said drive link having a first end and a second end, with an aperture defined in each end, the first end of said drive link being secured to said movable blade.

5. A unitary chain thread cutter assembly in accordance with claim 4, further comprising a double-acting piston arranged longitudinally with respect to said cutter section and displaceable in a longitudinal direction, said double-acting piston being connected to said drive link.

6. A unitary chain thread cutter assembly in accordance with claim 5, wherein said double-acting piston has a channel defined therein substantially perpendicular to its longitudinal axis for receiving the second end of said drive link so that displacement of said double-acting piston in a longitudinal direction displaces said drive link in a longitudinal direction and rotates said movable blade about the pivot point.

7. A unitary chain thread cutter assembly for a sewing machine having a top plate and a needle, comprising:

a single housing enclosing a cutter section and a driver section integral with said cutter section to form a unitary device, said housing being releasably mountable to the top plate of said sewing machine via a releasable universal tension mount affixed to said housing and adapted to receive the top plate of the sewing machine, said driver section driving said cutter section independently of positioning of the needle of said sewing machine.

* * * * *